United States Patent [19]

Noss

[11] 4,052,104

[45] Oct. 4, 1977

[54] SEATING UNIT

[76] Inventor: William H. Noss, 524 S. Muhlenberg St., Allentown, Pa. 18104

[21] Appl. No.: 709,455

[22] Filed: July 28, 1976

[51] Int. Cl.[2] ..... A47C 7/02

[52] U.S. Cl. ..... 297/456; 297/DIG. 1

[58] Field of Search ..... 5/91, 191, 351, 352, 5/355, 361 R, 361 B; 297/452, 455, 456, 458, DIG. 1, 284, DIG. 2, 80

[56] References Cited

U.S. PATENT DOCUMENTS

| | | | |
|---|---|---|---|
| 1,698,968 | 1/1929 | Rubenstein | 297/218 |
| 2,490,763 | 12/1949 | Winberg | 297/218 |
| 2,567,579 | 9/1951 | Russell | 297/218 |
| 3,188,137 | 6/1965 | Sarvas | 297/218 |
| 3,438,676 | 4/1969 | Brosk | 297/456 X |
| 3,476,497 | 11/1969 | Cashen | 297/445 X |
| 3,495,874 | 2/1970 | Dean | 297/456 |
| 3,642,323 | 2/1972 | Taylor | 297/456 |
| 3,675,970 | 7/1972 | Bereday | 297/452 |
| 3,679,263 | 7/1972 | Cadiou | 297/456 |
| 3,706,473 | 12/1972 | Mullen | 297/456 |

FOREIGN PATENT DOCUMENTS

| | | | |
|---|---|---|---|
| 2,047,958 | 4/1972 | Germany | 5/191 |

*Primary Examiner*—James C. Mitchell

*Attorney, Agent, or Firm*—Marn & Jangarathis

[57] ABSTRACT

A seating unit having a support structure including a contoured seating surface and a resilient foam covering the seating surface of the support, with the foam having a non-contoured seating surface. The foam includes a plurality of apertures or holes arranged such that upon being deformed by an occupant the seating surface of the foam assumes the shape of the contoured seating surface of the support. The unit is preferably formed of a plurality of individual sub-units of support and foam which are supported in a spaced relationship to form the seating unit.

7 Claims, 5 Drawing Figures

FIG. 1
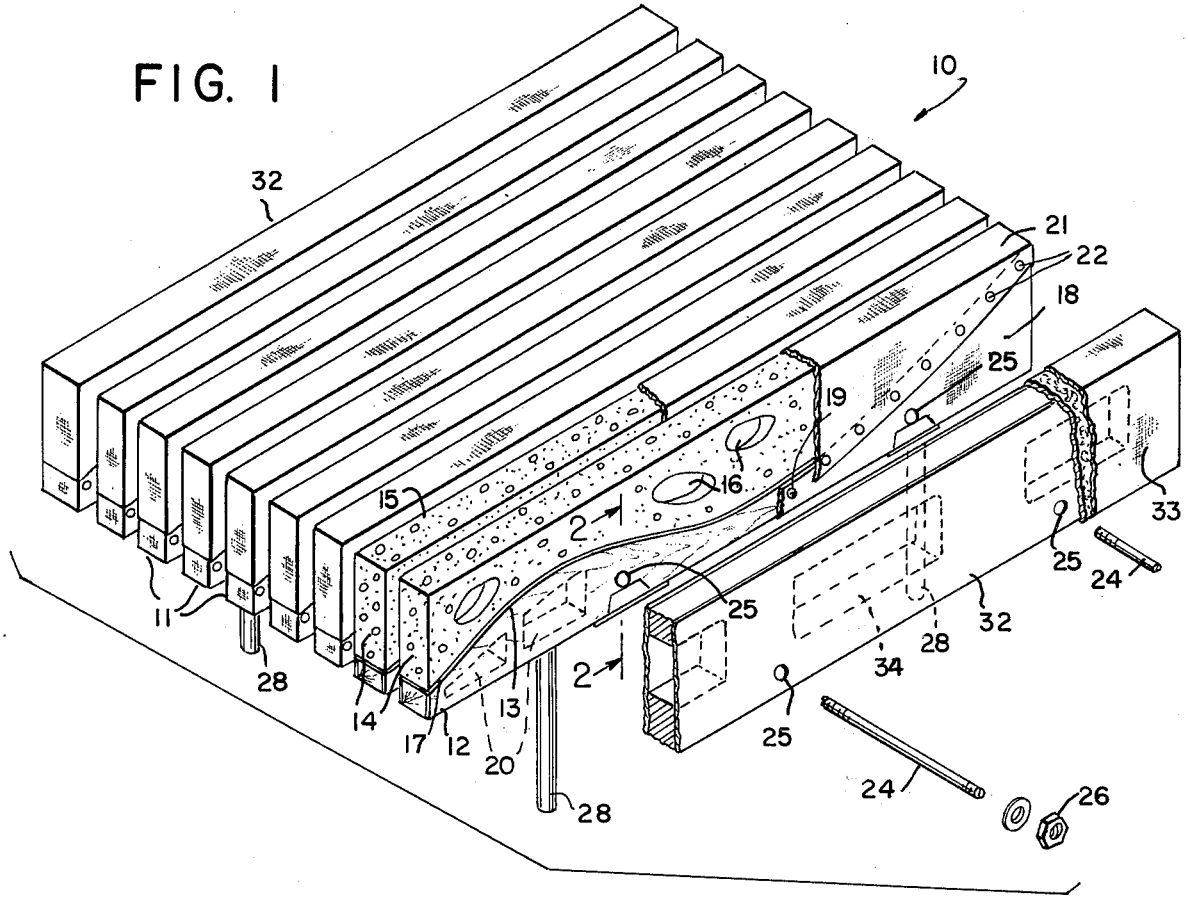
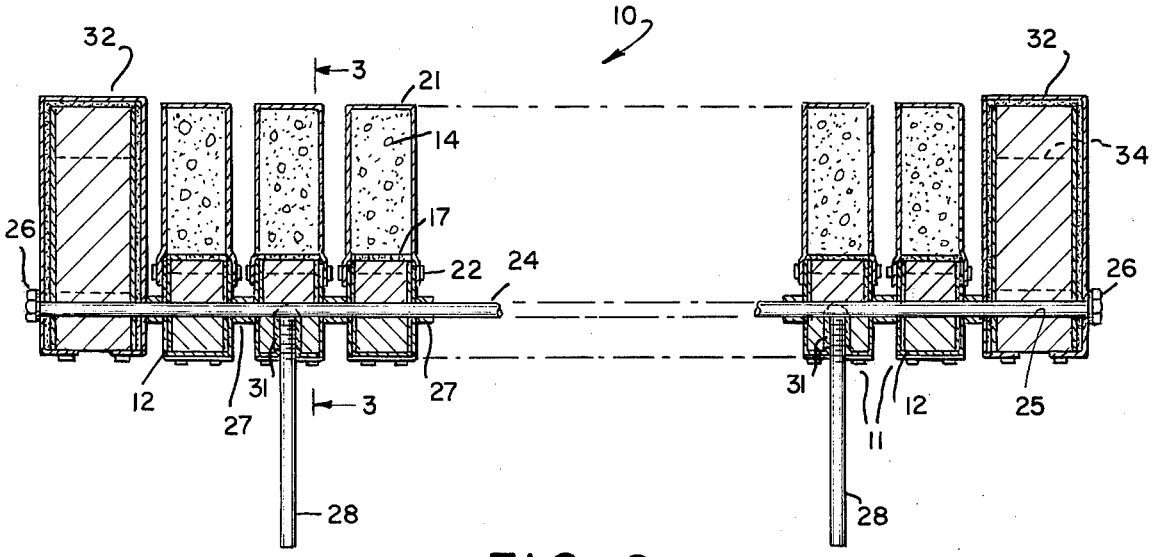
FIG. 2

SEATING UNIT

This invention relates to furniture, and more particularly, to new and improved seating units.

Furniture, such as seating units, are conventionally formed of a superstructure for supporting an occupant and a cushion or pillow for providing comfort to the occupant seated on the seating unit. The design of seating units has generally been limited by the practical necessity of shaping the unit to a contour which will comfortably seat an occupant whereby the unoccupied visual appearance of the unit has such a contour. As a result, there is a need for new and improved furniture the design of which is not limited to such seating contours.

An object of the present invention is to provide an improved seating unit.

A further object of the present invention is to provide a seating unit, which unoccupied, is not shaped like a seating unit.

A further object of the present invention is to provide a seating unit which can be easily constructed.

These and other objects of the present invention should be more apparent from reading the following description thereof.

In accordance with the present invention, there is provided a seating unit which is comprised of a support structure, which has a contoured seating surface and a resilient foam which covers the contoured seating surface, with the foam having a seating surface, with a normal shape, which does not conform to the shape of the contoured seating surface whereby the unoccupied visual appearance does not have the appearance of a seating unit. The foam includes a plurality of holes or cut-out portions which are shaped and arranged to provide the foam with sufficient flexibility whereby the seating surface of the foam, upon being deformed by an occupant, assumes the shape of the seating surface of the support with the occupant being supported by the support structure. In this manner, the seating unit can have an overall shape and contour which does not resemble a seating unit, with the seating unit taking the form of a seating unit, as defined by the shape and contour of the seating surface of the support structure, upon an occupant being seated thereon. Thus, in accordance with the present invention, the seating unit has a precontoured or shaped seating structure, as defined by the support superstructure, and assumes such shape when being occupied; however, when unoccupied, the seating unit does not have the visual appearance of a seating unit and can be configured to any one of a wide variety of shapes by shaping of the foam which overlies and is supported on the superstructure.

In accordance with the preferred aspect of the present invention, the support structure and foam thereon is comprised of a plurality of separate and independent members or sub-units which are joined together, preferably in a spaced relationship, to form an integral seating unit. The separate and independent members are preferably elongated members with the support structure portion of each of the elongated members or sub-units having the contour and shape of the overall seating unit. It is to be understood, however, that the sub-units need not be elongated, whereby the sub-units are formed of a plurality of sub-units which do not individually have the overall contour and shape of the seating unit.

The seating unit is covered with a suitable fabric, and in the case of the preferred seating unit, each of the individual members or sub-units is separately covered with the fabric, with the fabric preferably being removably attached to each of the members.

The support structure may be formed of any one of a wide variety of support materials, such as plastic, wood, metal, etc., which is capable of providing a supporting structure for an occupant.

The resilient foam which covers the support structure may be any one of a wide variety of foam materials which are resilient and return to their original shape subsequent to deformation thereof. A representative foam is a polyurethane foam; however, many other such foams are known in the art. The foam is then provided with cut-out portions or enlarged holes which are sized and arranged to provide the added flexibility whereby the foam, upon being deformed, assumes the contour of the supporting structure.

The seating units produced in accordance with the invention can be any one of a wide variety of seating units, including couches or sofas, lounges, love seats, individual chairs, high back chairs, etc.

Similarly, the foam portion of the seating unit can assume a wide variety of shapes, e.g., the seating surface of the foam, when unoccupied, can be planar or curved. The selection of suitable design or shape is deemed to be within the scope of those skilled in the art from the teachings herein.

The invention will be further described with respect to embodiments thereof illustrated in the accompanying drawings wherein:

FIG. 1 is an exploded isometric view, partially broken away. of an embodiment of the seating unit of the present invention;

FIG. 2 is a sectional view along line 2—2 of FIG. 1;

Figure 4:
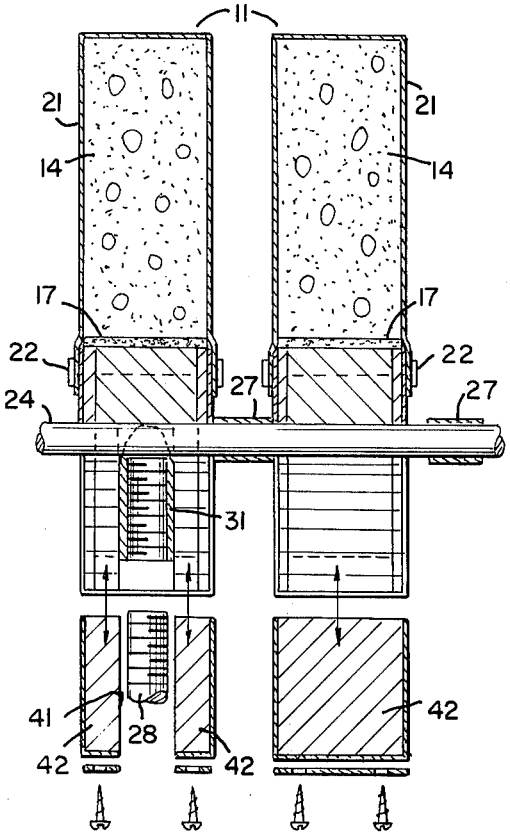
FIG. 4 is an exploded partial section along line 4—4 of FIG. 3.
Figure 3:
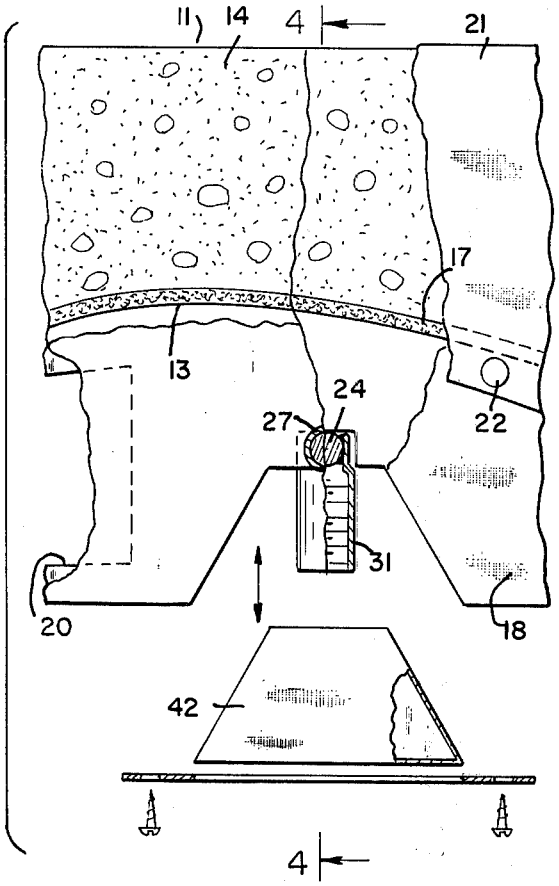
FIG. 3 is an exploded partial section along line 3—3 of FIG. 2.

It is to be understood, however, that the present invention is not to be limited to the embodiments described with reference to the drawings.

Referring to FIGS. 1–4 of the drawings, there is shown a seating unit 10, in the form of a lounge for two people, defined by a plurality of separate and independent elongated individual members or sub-units generally designated as 11. Each of the separate and independent members or sub-units 11 includes a support structure 12, formed of a suitable support material, such as wood, which includes a contoured seating surface 13 which is shaped to provide a back, seat and foot support for an occupant. As particularly shown, the surface 13 is contoured to provide a reclining support for an occupant; however, as should be apparent, the support can be countoured to provide any one of a wide variety of seating or reclining positions. The support structure 12, as particularly shown, includes cut-out portions 20 to decrease the weight of the support structure; however, it is to be understood that such portions are not required.

A resilient foam 14 covers and is supported on the contoured surface 13 of the support structure 12 and the outer seating surface 15 of the foam has a normal shape which does not conform to the contoured surface 13 of the support structure 12. As particularly shown, the outer seating surface 15 of the foam is planar, but as should be apparent to those skilled in the art, the surface could be curved.

The foam 14 is provided with a plurality of holes or cut-out portions 16 which are shaped and arranged therein to provide the foam with varying degrees of firmness and sufficient flexibility whereby the surface 15 of the foam 14, upon being deformed by an occupant, assumes the contoured shape of the seating surface 13 of the support structure 12, with the seating surface 13 of the support 12 thereby supporting an occupant.

The foam 14 is suitably secured on the surface 13 of support 12, and as particularly shown, the foam is secured to a compatible batting 17; e.g., by gluing, with the batting 17 being secured to the surface 13 of support 12; e.g., by staples. The use of other means for suitably securing the foam 14 to the support 12 is deemed to be within the scope of those skilled in the art.

Each of the individual members or sub-units 11 is covered with a suitable fabric to provide the desired visual appearance. As particularly shown, the support 12 is permanently covered with a first portion 18 of the fabric, which portion includes a plurality of male snaps 19, and a second portion 21 of the fabric, including corresponding female snaps 22, individually covers the foam 14 of each member 11, with the fabric portion 21 being removably secured by the snap connection. In this manner, the covering fabric of each individual member 11 can be removed fro cleaning. It is to be understood that other means for securing the fabric can be employed within the spirit and scope of the invention.

The individual members or sub-units 11 are interconnected and supported in a spaced relationship, to define an integral seating unit 10 in the form of a lounge for two people. As particularly shown, the lounge 10 is capable of seating two people; however, it is to be understood that the lounge could be designed for one individual or more than two individuals.

The seating unit 10 can be provided with appropriate armrests 32 or can be constructed without armrests. If employed, the armrests are individually constructed, from wood or the like, without a foam covering, with the armrest having an outer perimeter conforming to the outer perimeter of the undeformed individual seating members, except that the armrest is preferably somewhat wider than the individual seating members to visually inform a potential occupant of its function as an armrest. The armrest is covered with a fabric 33 and a batting as with the seating units, and preferably includes cut-out portions 34 to decrease the weight thereof.

The individual members 11 and armrests 32, when employed, are interconnected and supported by spaced parallel rods or pipes 24, formed of a suitable support material, such as metal, which extend transverse to the seating unit and pass through a first and second series of aligned holes 25 in the armrests 32 and the support structure 12 of each of the members 11, with the rods 24 being secured to the end units by suitable fastening means, such as nuts 26. The pipes 24 include suitable spacing members, such as sleeves 27, which are positioned between the individual members 11 and armrests to maintain the members 11 in a predetermined spaced relationship.

The lounge further includes legs 28 which are suitably connected for supporting the lounge above a floor surface. As particularly shown, the lounge includes four metal legs 28, with the rear legs being longer than the front legs to provide an inclined support. The legs 28 are secured, as appropriate positions, by a threaded connection to a threaded metal connector 31, which is suitably secured, such as by a weld, to the pipe or rod 24, with the connector 31 and legs being received in an appropriate aperture 41 provided in the support structure 12 of the individual members 11 where the legs are to be secured. The support structure 12 of the individual members 11 are provided with removable pieces 42 in order to permit removal of the rod and connector.

It is to be understood that the legs can be secured to the unit in a manner other than as particularly described. In addition, the seating unit could be constructed without legs whereby the support structure 12 would be positioned directly on the floor and have an appropriate shape to accomodate seating above the floor.

As should be apparent, the seating unit does not have the visual appearance of a seating unit, yet the seating unit is shaped to provide a predetermined seating contour and when occupied assumes such predetermined seating contour. Moreover, by being formed of a plurality of individually spaced seating sub-units, construction and covering thereof is facilitated, and in addition, there is provided an overall aesthetically pleasing appearance of a floating dismembered surface.

Figure 5:
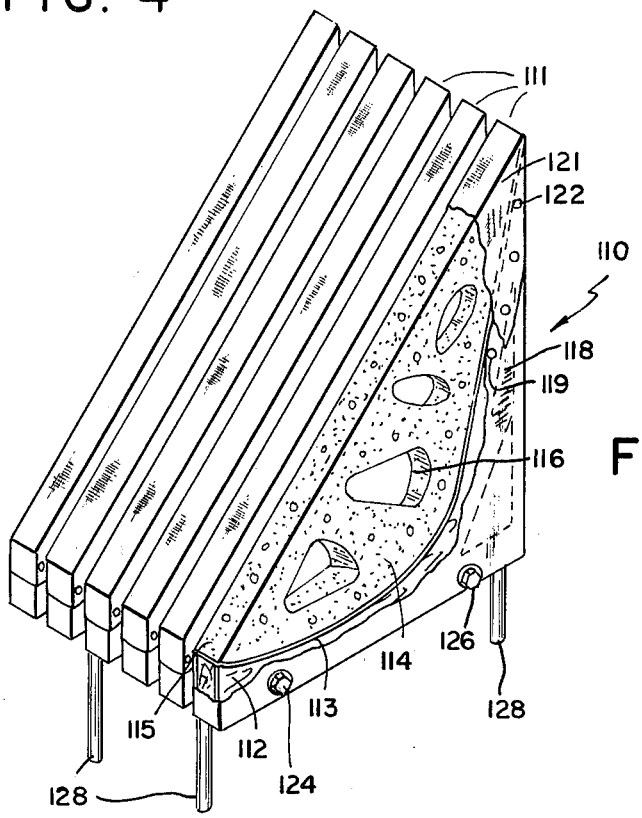
FIG. 5 is a partially broken isometric view of another embodiment of the seating unit of the present invention.

Another embodiment of the present invention is shown in FIG. 5 which illustrates another seating unit 110, in the form of a highbacked chair, produced in accordance with the present invention. In FIG. 5, like parts are indicated by like hundreds reference numerals. As in the embodiment illustrated in FIGS. 1 to 4, the high-back chair is formed of a plurality of individual and separate seating sub-units or members 111, each of which includes a support structure 112, having a seating surface 113 which is contoured or shaped to provide a seating cavity and back support of the desired contour. The surface 113 of each support is covered with resilient foam 114 having an outer inclined planar seating surface 115 which does not conform to the contoured surface 113 of the support structure 112. The foam 114 includes a plurality of holes or cut-out portions 116 which are shaped and arranged therein to provide the foam with sufficient flexibility, whereby the surface 115 of foam 114, upon being deformed by an occupant, assumes the contoured shape of the seating surface 113 of the support structure 112, with the seating surface 113 thereby supporting the occupant.

The individual members are covered with a suitable fabric, as described with reference to the embodiment of FIGS. 1 - 4, and the individual member are interconnected and supported by transverse pipes or rods 124, which pass through a first and second series of spaced aligned apertures in the support structure 125 of the individual members 111, with the rods 124 being secured by nuts 126, at the ends thereof, to either the end seating units, or armrests. The chair is mounted above the floor by suitable legs 128, with the legs being connected to the pipes 124, as described with respect to the embodiment of FIGS. 1 to 4.

The seating unit of the present invention is not limited to the embodiments particularly described with reference to the drawings. Thus, for example, each of the individual members 11 could be formed of a plurality of sub-units comprised of support and foam instead of a single elongated sub-unit as particularly shown.

Similarly, the foam portion can have a contour other than the planar contour particularly shown.

Furthermore, the seating unit can take a form other than a lounge or high-back chair.

These and other modifications should be apparent to those skilled in the art from the present teachings.

The present invention is particularly advantageous in that there is provided a seating unit which when unoccupied does not have the appearance of a seating unit and which provides a floating dismembered appearance.

Numerous modifications and variations of the present invention are possible in light of the above teachings and, therefore, within the scope of the appended claims, the invention may be practiced otherwise than as particularly described.

What is claimed is:

1. A seating unit, comprising:

a support structure including a contoured seat and back support, said support structure being comprised of a plurality of separate and independent sub-units, each contoured to include a portion of the seat and back support; a plurality of separate and independent pieces of resilient foam covering the seat and back support portions of each of said sub-units, said resilient foam having a non-seat and back shaped outer seating surface which is in non-conformity with the contour of the sub-unit, said resilient foam including a plurality of apertures shaped and arranged to provide the foam with sufficient flexibility whereby the foam upon being deformed by an occupant assumes a seat and back support shape corresponding to the contoured seat and back support of the support structure and the occupant is supported by the support structure; fabric covering each foam covered sub-unit; and means for supporting the individual fabric and foam covered sub-units in a spaced relationship to each other to form the seating unit of a plurality of individual spaced fabric and foam covered sub-units having spaces therebetween, whereby the unoccupied seating unit has a dismembered non-seating unit visual appearance, which provides a pre-determined seating contour when occupied.

2. The seating unit of claim 1 wherein the fabric covering is removable.

3. The seating unit of claim 1 wherein the means for supporting said sub-units in a spaced relationship comprises first and second spaced elongated rods which extend through the support structure of said sub-units in a direction transverse to the seating unit, said rods including spacer members between the sub-units to maintain the spaced relationship and legs secured to the rods.

4. The seating unit of claim 3 wherein the seating surface of the foam is normally planar.

5. The seating unit of claim 4 wherein the seating unit is in the form of a lounge, said support structure including a leg supporting surface and said foam covering said leg supporting surface.

6. The seating unit of claim 4 wherein the seating unit is in the form of a high-back chair, said foam having a normally inclined planar seating surface.

7. The seating unit of claim 4 wherein the seating unit further includes armrests, said armrests being supported in a spaced relationship with respect to said sub-units.

* * * * *